United States Patent [19]

Hori et al.

[11] Patent Number: 4,933,654

[45] Date of Patent: Jun. 12, 1990

[54] POLARIZED ELECTROMAGNETIC RELAY

[75] Inventors: Masami Hori; Yoshinobu Okada; Norimasa Kaji; Hiromi Nishimura, all of Osaka, Japan

[73] Assignee: Matsushita Electric Works, Ltd., Japan

[21] Appl. No.: 411,313

[22] Filed: Sep. 22, 1989

[30] Foreign Application Priority Data

Sep. 27, 1988 [JP] Japan ..... 63-125943[U]
Jun. 27, 1989 [JP] Japan ..... 01-75282[U]

[51] Int. Cl.[5] ..... M01H 51/22
[52] U.S. Cl. ..... 335/78; 335/229
[58] Field of Search ..... 335/78–85, 335/121, 124, 128, 229, 230

[56] References Cited

U.S. PATENT DOCUMENTS 3,470,510 9/1969 Richert ..... 335/230
4,639,702 1/1987 Sato ..... 335/81

*Primary Examiner*—Leo P. Picard
*Assistant Examiner*—L. Donovan
*Attorney, Agent, or Firm*—Stevens, Davis, Miller & Mosher

[57] ABSTRACT

A polarized electromagnetic relay having a pair of first and second pole members which are magnetized to opposite polarity by a permanent magnet coupled thereto and which define therebetween a magnetic gap into which the other end of the armature extends. The first pole member and the armature are magnetically coupled to the base so as to cause a magnet flux of the permanent magnet to circulate through the second pole member, the armature, the base, and the first pole member for attracting the armature to the second pole member. Upon energization of the coil, a resulting coil flux circulates through the armature, the base, and the first pole member in opposing direction to the magnet flux for attracting the armature to the first pole member. A cover and base of magnetic material is included to fit over the base and be magnetically coupled thereto. The second pole member is disposed adjacent to the inner wall of the cover so as to define therebetween an air gap which is cooperative with the second pole member, the armature, base, and the cover in order to circulate an additional coil flux in the opposing direction to the magnet flux across the second pole member and the armature upon energization of the coil, weakening the magnetic flux and therefore expediting the armature movement by the coil flux to thereby improve repsonse sensitivity.

5 Claims, 10 Drawing Sheets

30
27
22
24
24
22
20
21
26
25
32
33
31
33
70
71
50
11
63
63
60
62
62
61
61
10
84
82
83
81
17
91
92
90
92
42
43
41
44

28
28B
21B
29
20B
26B
25B
50B
12
84B
82B
11B
83B
13
81B
10B
42B
41B
90B
43B 90A
96A
95A
99

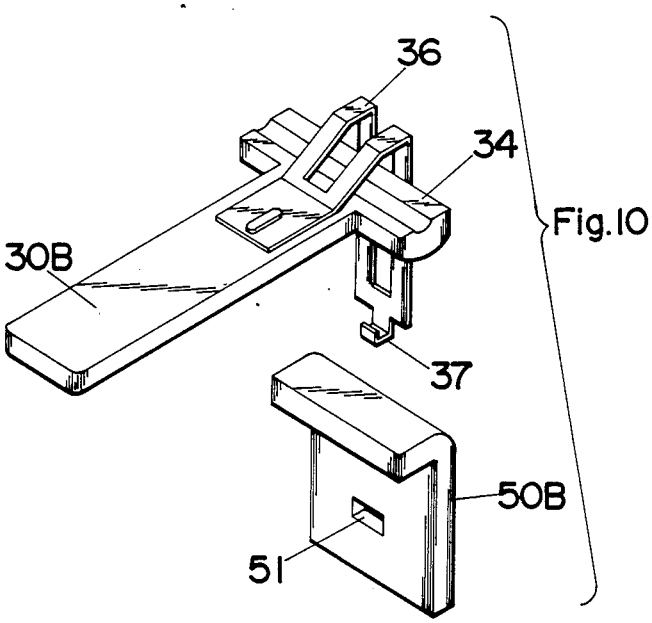
Fig.11
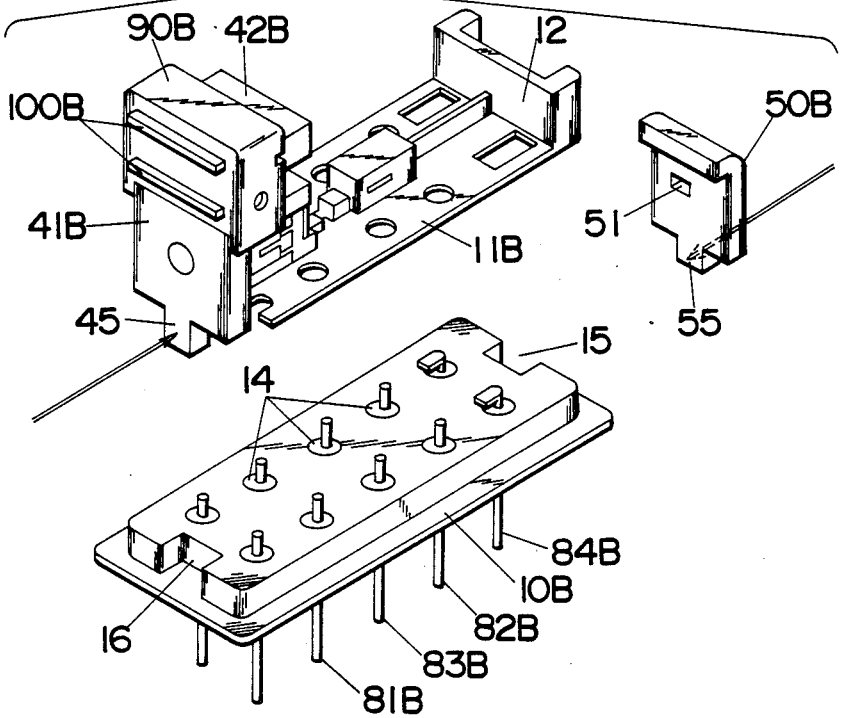

Fig.14
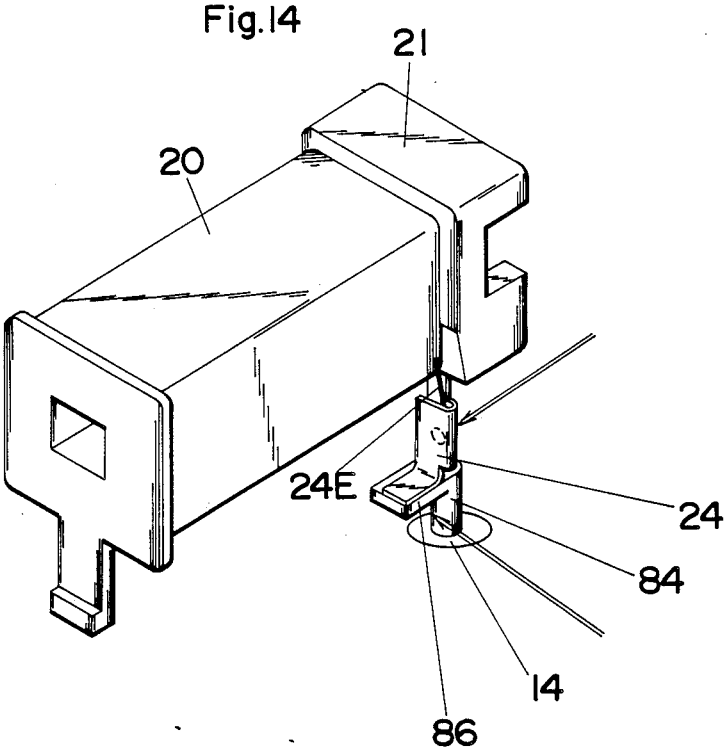
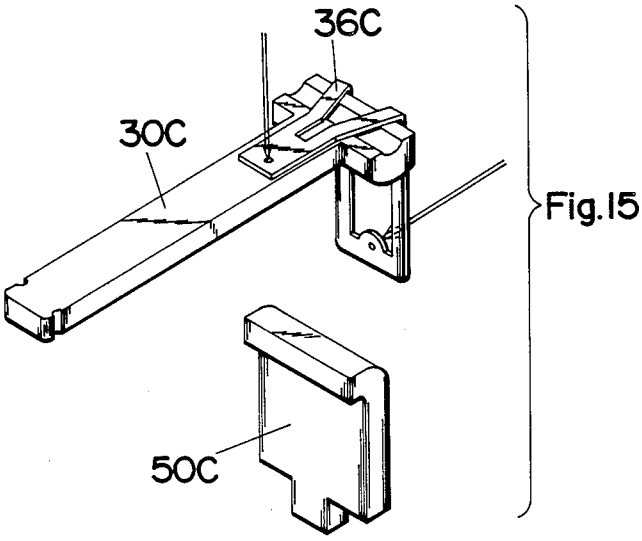
Fig.15

POLARIZED ELECTROMAGNETIC RELAY

BACKGROUND ART

1. Field of the Invention

The present invention is directed to a polarized electromagnetic relay, and more particularly to a polarized relay having a base of magnetic material which forms a part of flux path for driving an armature between two positions of opening and closing a relay contact.

2. Description of the Prior Art

Polarized relays having a base of magnetic material which forms a part of magnetic flux path are known in the art. The magnetic circuit of the prior polarized relay can be schematically illustrated in FIG. 1, in which a polarized electromagnet is mounted on the base 1 of magnetic material. The polarized electromagnet comprises an excitation coil 2, an armature 3 magnetically coupled to the base 1 through a yoke 5 and extending through the coil 2, and a pair of first and second pole members 4 and 6 magnetized to opposite polarity by an permanent magnet 7 interposed therebetween. The armature 3 is pivotally supported at its one end to the top of the yoke 5 with the other end thereof extending into a magnetic gap between the first and second pole members 4 and 6. The first pole member 4 is magnetically coupled to the base 1 so that, when the coil 2 is deenergized, a magnet flux emanating from the permanent magnet 7 circulates, as indicated by an arrow M in the figure, through the first pole member 4, the base 1, the yoke 5, the armature 3, and the second pole member 6 to thereby hold the armature 3 in an illustrated rest position of being attracted to the second pole member 6. Upon energization of the coil 2 to develop a coil flux opposing the magnet flux, the coil flux circulates, as indicated by an arrow C in the figure, through the armature 3, the yoke 5, the base 1, the first pole member 4, and through the magnetic gap between the first pole member 4 and the armature 3. The coil flux developed by the coil 2 is sufficient in strength to overpower the magnet flux of the permanent magnet 7 to thereby force the armature 3 to a set position where the other end of the armature 3 is attracted to the second pole member 6. The above magnetic structure, however, encounters a problem that as the gap between the first pole member and the armature end becomes greater, the coil flux suffers from a correspondingly increased magnetic resistance at that gap. Therefore, the coil flux must be correspondingly greater in strength enough to overcome the magnet flux of the permanent magnet at the initial movement of attracting the armature to the first pole member away from the second pole member, although it requires no such greater strength once the armature moves out of the second pole member to shorten the gap. Consequently, it is mostly desired to expedite the armature off the rest position at the beginning of the armature movement toward the set position for improving response sensitivity without unduly increasing the magnetic strength of the excitation coil.

SUMMARY OF THE INVENTION

The above problem is successfully eliminated in the present invention which provides an improved polarized electromagnetic relay. The polarized relay of the present invention comprises a base of magnetic material on which an electromagnet and a contact assembly are mounted, and a cover fitted over the base to enclose therebetween the electromagnet and the contact assembly. The electromagnet includes an excitation coil, an armature extending through the coil and pivotally supported at its one end to the base, and a pair of first and second pole members magnetized to opposite polarity by a permanent magnet coupled thereto. The contact assembly includes at least one movable contact which is operatively connected to the armature to be in and out of contact with an associated fixed contact. The first and second pole members define therebetween a magnetic gap into which the other end of the armature extends such that the armature is pivotable between a rest position in which the armature is attracted to the second pole member and a set position in which the armature is attracted to the first pole member. The armature and the first pole member are magnetically coupled to the base without any substantial intervening air gap therebetween so that a magnet flux emanating from the permanent magnet can circulates through the first pole member, the base, the armature, and through the second pole member to thereby attract the armature in the rest position and hold it in this position unless the coil is energized. Also with the provision of magnetically coupling the first pole member and the armature through the base, a coil flux developed upon selective energization of the coil to oppose the magnet flux can circulate through the armature, the base, the first pole plate to attract the armature to the set position against the magnet flux. The characterizing feature of the present invention resides in that the cover is made of magnetic material and magnetically coupled to the base, and in that the second pole member is positioned adjacent to the cover to define therebetween such an air gap that is cooperative with the second pole member, the armature in the rest position, the base, and the cover to form an auxiliary flux loop. The auxiliary flux loop is responsible for causing additional coil flux to circulate therethrough in opposing direction to the magnet flux upon the energization of the coil, thus providing the additional coil flux particularly to the portion between the second pole member and the armature in the rest position to thereby weaken the opposing magnet flux. With this result, once the coil is energized the armature can have less influence from the permanent magnet or less reluctant so that it can be promptly attracted out of the second pole member or the rest position to the first pole member or the set position.

Accordingly, it is a primary object of the present invention to provide an improved polarized electromagnetic relay in which the cover of the magnetic material can be best utilized to form a part of the auxiliary coil flux path in order to improve response sensitivity in moving the armature from the rest position to the set position upon energization of the excitation coil.

In a preferred embodiment, the first and second pole members are held together with the permanent magnet in a frame of non magnetic material mounted on the base. The frame is formed at a portion adjacent the second pole member with stop projections which abut against the inner surface of the cover so as to determine the above air gap of a constant distance between the second pole member and the cover.

It is therefore another object of the present invention to provide an improved polarized electromagnetic relay in which the second pole member can be positioned in an exact relation to the cover to assure the air gap of fixed distance between the second pole member and the cover, giving reliability to the intended armature operation.

In the embodiment, the armature is magnetically coupled to the base through a yoke upstanding from the base. The armature has at the one end a transversely extending pivot projection which is supported on the top of the yoke to define a pivot axis about which the armature pivots between said rest and set positions. With this pivot structure, the armature can have a fixed pivot axis and therefore can have a fixed area of contact with the yoke during its pivot movement so as to be free from fluctuation of magnetic resistance, contributing to a stable operation characteristic, which is therefore a further object of the present invention.

The movable contact is provided in the form of a spring which acts on the armature to bias the armature to a neutral position between the rest and set positions. Since the armature can have a desired attraction characteristic by adjusting the above gap distance or magnetic resistance between the second pole member and the cover, the armature can have its attraction force easily balanced with the spring bias so as to obtain an optimum armature movement required in the relay operation, which is therefore a further object of the present invention.

The present invention disclose a further advantageous feature that the first pole member and the yoke are secured at their respective lower ends to the base by laser welding. With the use of laser welding technique, the first pole member and the yoke can be fixed on the base to have precise spacial relationships with the associated members to thereby improve dimensional stability and therefore assure a reliable relay operation. This is important particularly when the relay is required to be miniaturized.

These and still other objects and advantageous features of the present invention will become more apparent from the following description of the preferred embodiments when taken in conjunction with the attached drawings.

BRIEF DESCRIPTION OF THE DRAWINGS

FIG. 10 is a perspective view illustrating a pivot connection of an armature to a yoke by means of a spring holder employed in the second embodiment;

FIG. 11 is an exploded perspective view of the relay illustrating the radiating directions of the laser welding employed for mounting an electromagnet to the base;

FIG. 14 is a perspective view illustrating directions of laser radiation for welding of a coil of the electromagnet to a corresponding terminal pin; and FIG. 15 is a perspective view illustrating directions of laser radiation for welding of the spring holder to the armature and the yoke.

DETAILED DESCRIPTION OF THE PREFERRED EMBODIMENTS

First embodiment FIGS. 2 to 5

Figure 1:
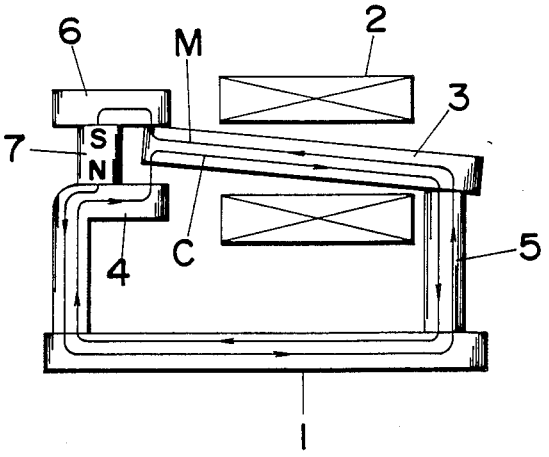
Fig. 1 (PRIOR ART)
FIG. 1 is a schematic diagram showing a magnetic circuit of a prior polarized electromagnetic relay.
Figure 2:
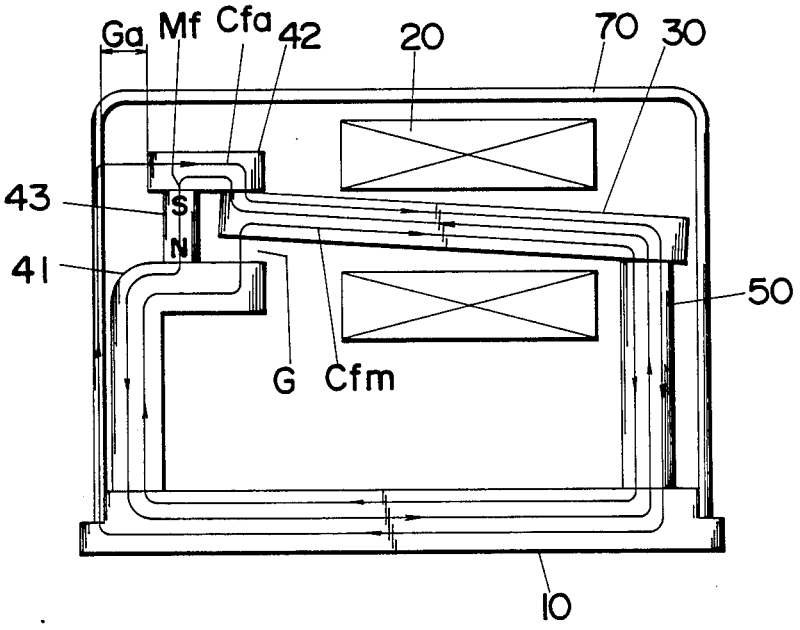
FIG. 2 is a schematic diagram showing a magnetic circuit of a polarized electromagnetic relay in accordance with the present invention.
Figure 3:
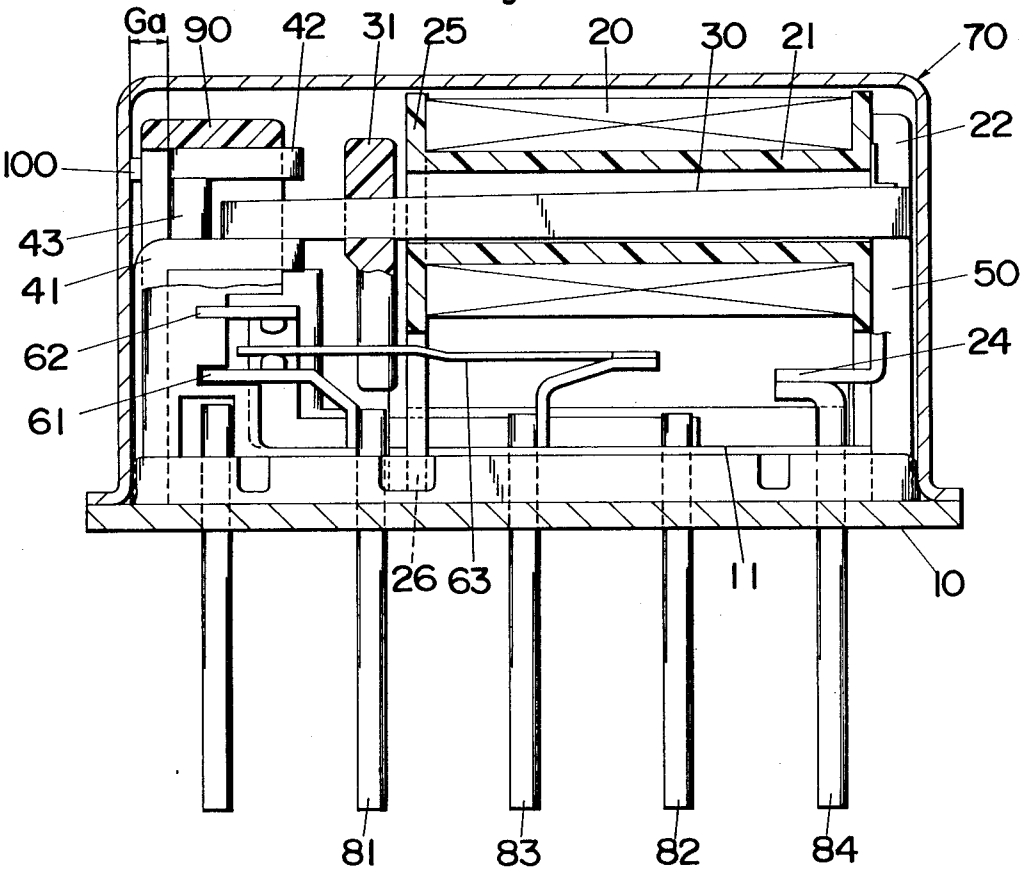
FIG. 3 is a sectional view, partly broken away, of the relay in accordance with a first embodiment of the present invention.
Figure 4:
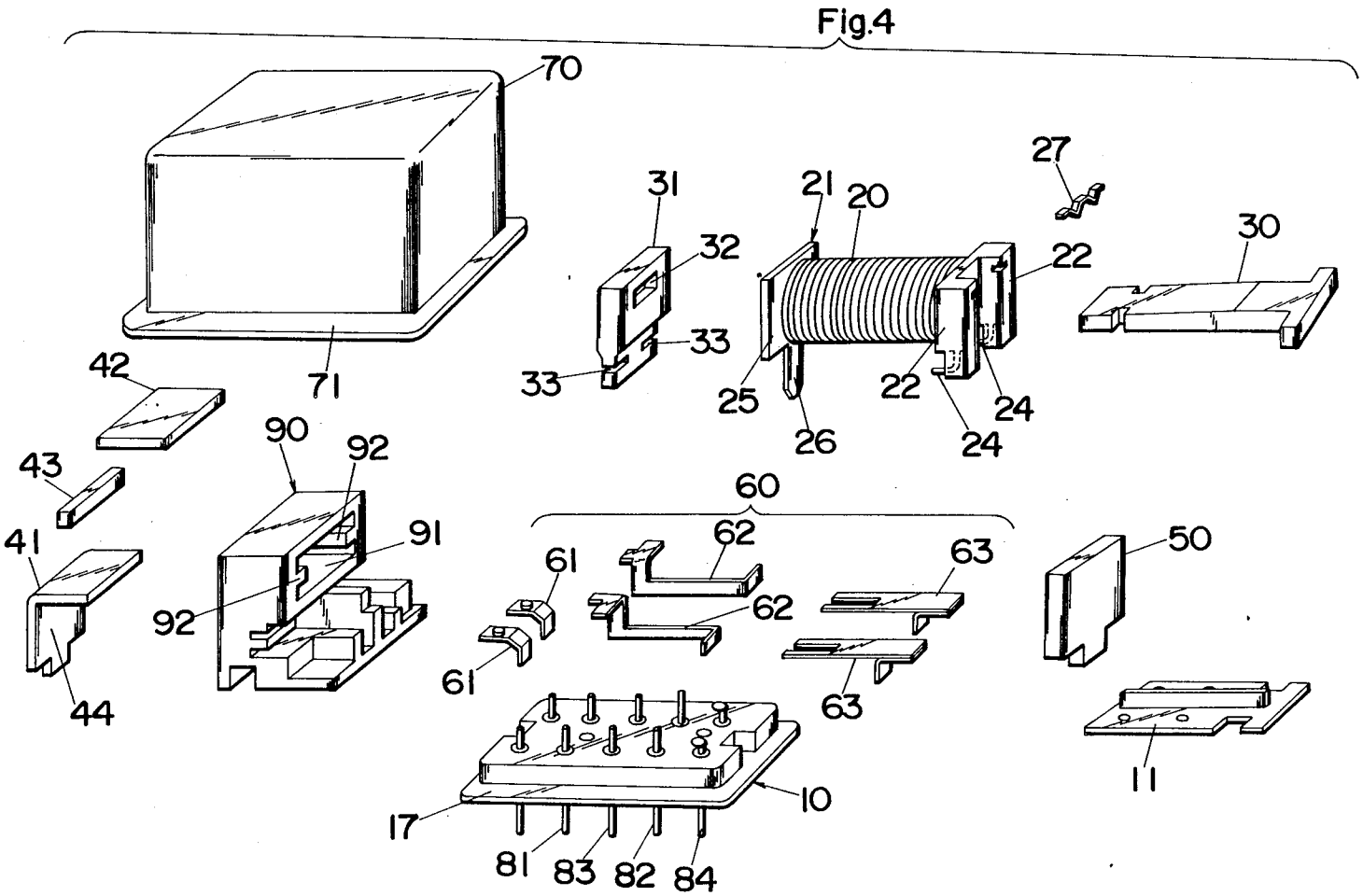
FIG. 4 is an exploded perspective view of the above relay.

Referring now to FIGS. 3 and 4, there is shown a polarized electromagnetic relay in accordance with a first embodiment of the present invention. The relay is of a mono-stable type and comprises a base 10 mounting thereon an electromagnet and a contact assembly 60, and a cover 70 fitted over the base 10 to hermetically seal the electromagnet and the contact assembly 60 between the base 10 and the cover 70. The base 10 and the cover 70 are made of metallic magnetic material which forms portions of magnetic flux paths with the electromagnet. The electromagnet comprises an excitation coil 20, an armature 30 extending horizontally through the coil 20, a pair of first and second pole members 41 and 42 magnetized to opposite polarity by a permanent magnet 43 interposed therebetween. The armature 30 is pivotally supported at its one end on the upper end of an uprightly extending yoke 50 on the base 10 with the other end projecting into a magnetic gap G formed between the first and second pole members 41 and 42, so that it is pivotable between a rest position of being attracted to the second pole member 42 and a set position of being attracted to the first pole member 41. The first pole member 41 has a leg 44 bent downwardly and magnetically coupled to the base 10. The armature 30 is magnetically coupled at its pivot end to the yoke 50 which is also magnetically coupled to the base 10 so that the armature 30 is magnetically coupled to the first pole member 41 and to the second pole member 42 through the permanent magnet 43. Thus, as shown in FIG. 2, a magnet flux loop is established to circulate a magnet flux Mf emanating from the permanent magnet 43 through the first pole member 41, base 10, yoke 50, armature 30 and second pole member 42, as indicated by an arrow in the figure, to attract the armature 30 to the illustrated rest position and hold it in this position unless the coil 20 is energized. Thus, the armature 30 is stable at the rest position and attracted to the set position upon energization of the coil 20.

The contact assembly 60 comprises two set of contact members each comprising a first fixed contact 61, a second fixed contact 62, and a movable contact 63 which are secured to corresponding terminal pins 81 to 83 extending through the base 10. The movable contact 63 is connected to the armature 30 by means of a card 31 of electrically and magnetically insulating material so that the movable contact 63 is kept contact with the second fixed contact 62 when the armature 30 is in the rest position and comes into contact with the first fixed contact 61 when the armature 30 is attracted to the set position. In this regard, the first contact 61 is a normal)y open contact and the second contact 62 is a normal closed one. For connection of the armature 30 to the movable contacts 63, the card 31 is formed with a hole 32 engaging the end portion of the armature 30 and also formed with a pair of slits 33 each engaging the free end portion of the movable contact 63 in each contact set. It is noted in this connection that the movable spring 63 is a spring leaf which biases the armature 30 to a neutral position between the rest and set position, and that the armature 30 is retained in the rest position by the permanent magnet 43 against the spring bias of the movable contact 63, as seen from FIG. 6. The figure illustrates three curves M, C, and S of forces applied to the armature 30 which vary with changing positions between the rest position and the set position, in which curves M and C represent attraction forces applied to the armature 30 respectively from the permanent magnet 43 and from the excitation of the coil 20, and curve S represents a spring force applied to the armature 30 to urge it to the neutral position.

The coil 20 is supported on a bobbin 21 of plastic insulation material which is mounted on the base 10 with an insulation plate 11 interposed therebetween. Formed at one end of the bobbin 21 is a pair of laterally spaced posts 22 which are mounted on the base 10 in such a manner that the yoke 50 is fitted between the posts 22 for exact positioning of the bobbin 21 on the base 10. Coil leads 24 extend through the posts 22 and are fastened to corresponding coil terminal pins 84 extending through the base 10. The other end of the bobbin 21 has an end plate 25 with an anchor leg 26 for connection with the base 10. A retainer spring 27 bridges between the upper ends of the posts 22 so as to press the end of the armature 30 on the upper end of yoke 50 for effecting the pivot connection therebetween.

Figure 5:
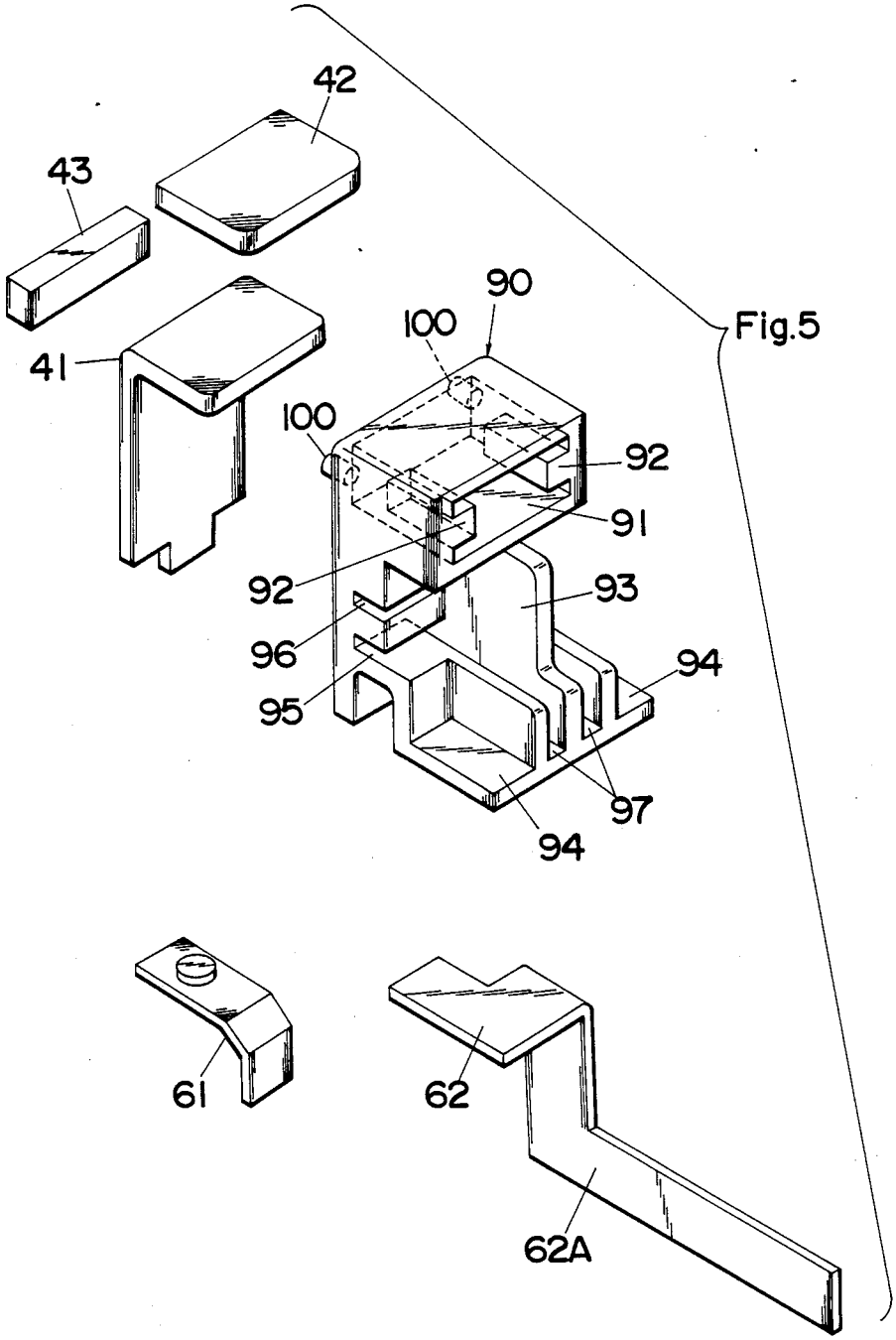
FIG. 5 is an exploded perspective view of a frame utilized in the above embodiment to hold first and second pole members and other associated parts.

A frame 90 of plastic material is mounted on the end of the base 10 opposite to the yoke 50 in order to hold together the first and second pole members 41 and 42, and the permanent magnet 43. The frame 90, which may be formed separately from or integrally with the insulation plate 11, has in its upper end an opening 91 with a pair of ribs 92 which extend horizontally on the side walls of the opening 91. As best shown in FIG. 5, the upper plate portion of the first pole member 41 is inserted into the opening 91 from rearward and retained below the ribs 92. Likewise the second pole member 42 is inserted into the opening 91 and retained above the ribs 92. Thus, the first and second pole members 41 and 42 are separated within the opening 91 by a distance corresponding to the thickness of the ribs 92 to provide a fixed distance to the magnetic gap G between which the armature 30 travels. The rear ends of the ribs 92 are cut out to receive thereat the permanent magnet 43 in contact with the first and second pole members 41 and 42. A vertical wall 93 is formed at the lower portion of the frame 90 to divide the same into two laterally spaced sections 94 each retaining the first and second fixed contacts 61 and 62 in each contact set. To this end, each section 94 is provided with lower and upper horizontal grooves 95 and 96 for receiving the ends of the first and second fixed contacts 61 and 62. Each section 94 also has a vertical groove 97 adjacent the wall 93 for receiving the portion of a vertical segment 62A of the second contact 62. Due to the above structure of the frame 90, the magnetic gap between the first and second pole members 41 and 42 as well as the contact gap between the first and second fixed contacts 61 and 62 are precisely maintained, giving rise to a stable and reliable relay operation characteristic.

Figure 6:
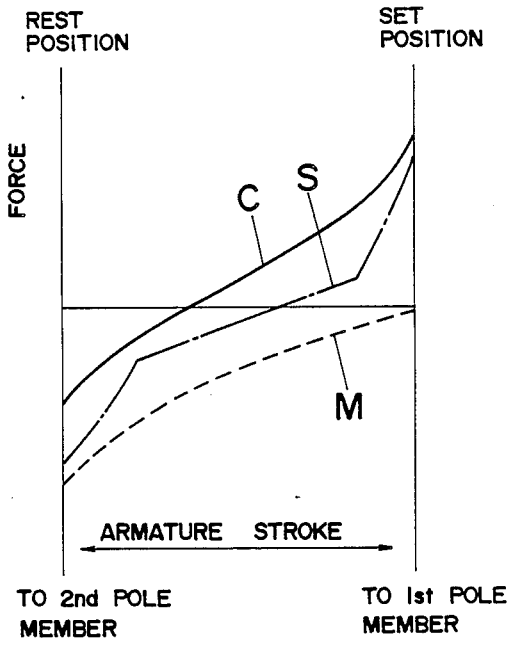
FIG. 6 is a chart illustrating magnetic and spring forces applied to an armature of the relay at varying positions between a rest position and a set position.
Figure 7A:
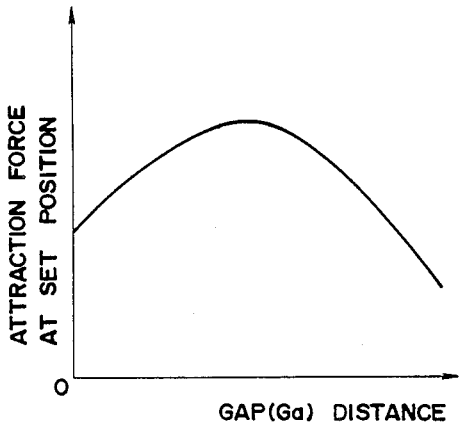
FIGS. 7A and 7B are respectively graph charts illustrating curves of forces, which are applied to the armature when an excitation coil is energized and deenergized, in relation to varying gap distance between the second pole member and the cover.
Figure 7B:
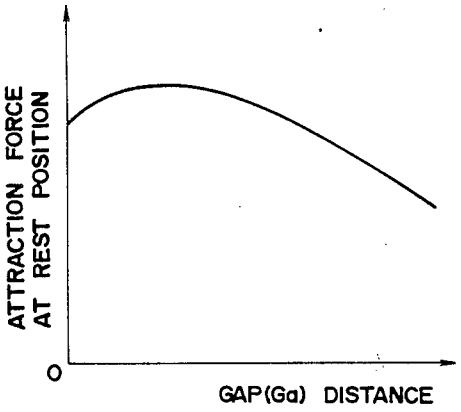

The frame 90 is also formed on its rear surface with stop projections 100 which abut against the inner surface of the cover 70 to give a fixed distance between the cover 70 and the second pole member 42. The distance defines an additional magnetic gap Ga which is cooperative with the cover 70 of magnetic material to form an important flux path upon energization of the coil 20 for repelling the armature 30 out of the second pole member 42 towards the first pole member 41. FIG. 2 illustrates magnetic circuits of the present invention in which the armature 30 is shown to be held in its rest position by the magnet flux Mf circulating from the permanent magnet 43 through the first pole member 41, the base 10, the yoke 50, the armature 30, the second pole member 42, and back to the magnet 43. When the coil 20 is energized by a current of particular direction, a main coil flux Cfm opposing the magnet flux Mf is developed to circulate in the illustrated direction through a main coil flux path including the armature 30, the yoke 50, the base 10, the first pole member 41, and the magnetic gap G between the first pole member 41 and the armature 30. At this instance, an additional coil flux Cfa is developed to circulate in the arrowed direction through an auxiliary flux path which includes the armature 30, the yoke 50, the cover 70, the additional gap Ga, and the second pole member 42. As seen in the figure, since the additional coil flux Cfa opposes also to the magnet flux Mf particularly across the second pole member 42 and the armature 30, the magnet flux Mf of the permanent magnet 43 will be considerably weakened when the armature 30 is around the rest position to thereby expedite the armature 30 to be attracted by the main coil flux Cfm towards the first pole member 41 or the set position. As the armature 30 moves out of the rest position, the additional coil flux Cfa sees an increasing reluctance and the main coil flux Cfm becomes predominant to attract the armature 30 to the set position or the first pole member 41. Thus, the armature 30 can be promptly shifted from the rest position to the set position upon energization of the coil 20, thereby giving improved response sensitivity to the armature or the relay operation. Upon deenergization of the coil 20, the armature 30 is caused to return to rest position by the magnet flux Mf. In FIG. 6, curve C represents an attraction force developed by the main coil flux Cfm to act on the armature 30 with varying position between the rest and set positions. As seen from the figure, curve C is shifted upwardly to indicate a less attraction force is required at the rest position than at the set position in effecting the desired armature movement. This confirms that the armature 30 can be permitted to move out of the rest position promptly with a less attraction force and to be attracted forcibly towards the set position by a greater attraction force enough to overpower the spring bias. The above additional gap Ga is suitably selected to have a value in order to expedite the armature 30 off the second pole member 42 at the very beginning of the armature movement towards the set position. As seen in FIGS. 7A and 7B, as the distance of the above additional gap Ga varies, the armature 30 receives an attraction force of varying strength at the set position (FIG. 7A) and also at the rest position (FIG. 7B). In consideration of this, the gap distance Ga can be selected to exert maximum attraction forces for shifting the armature 30 to the set position upon energization of the coil and for returning it to the rest position upon deenergization of the coil 20. Thus, the magnetic attraction forces to be applied to the armature 30 can be easily adjusted by varying the gap distance Ga and therefore be easily balanced with the spring bias also applied to the armature 30 by the movable contact 43, facilitating to obtain a desired relay operation characteristic.

Figures 8, 9:
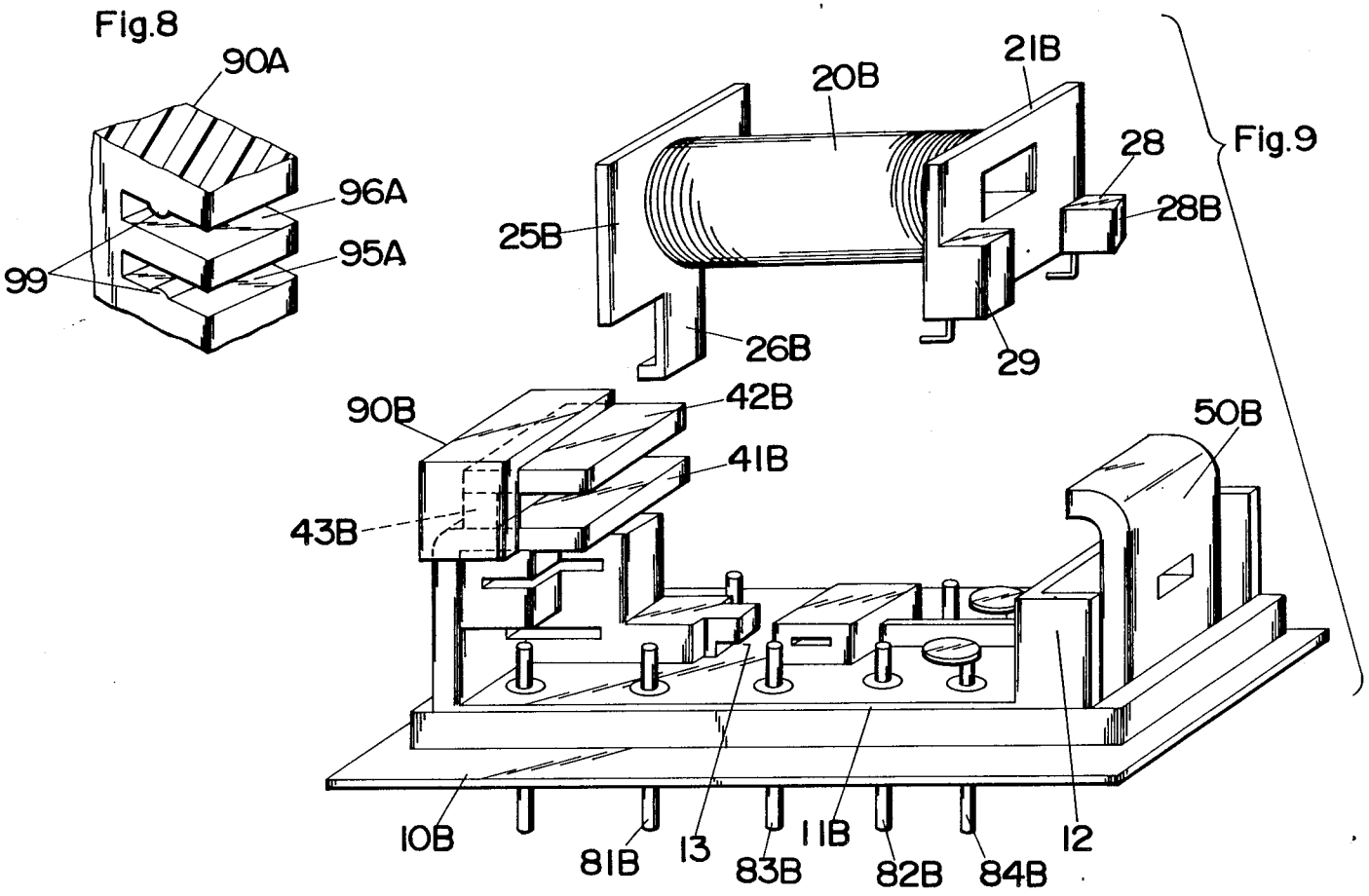
FIG. 8 is a perspective view of a portion of a modified frame supporting fixed contact members.
FIG. 9 is an exploded perspective view of a polarized relay in accordance with a second embodiment of the present invention.

FIG. 8 shows a modified structure of a frame 90A for holding the first and second pole members 41 and 42. The modified frame 90A is formed in lower and upper grooves 95A and 96A with grip bulges 99 for firm engagement with the end portion of first and second fixed contacts inserted therein, giving an enhanced dimensional stability to the contact gap.

Second embodiment FIGS. 9 and 10

FIG. 9 illustrates a polarized relay in accordance with a second embodiment of the present invention which is identical in configuration to the first embodiment except for a mounting structure of a coil bobbin 21B. Therefore, like parts are designates by like numerals with a suffix letter of "B" for an easy reference purpose. The bobbin 21B has at its one end a pair of laterally spaced studs 28 and 29 which rest on an end wall 12 upstanding integrally from an insulation plate 11B on a base 10B. The other end of the bobbin 21B has a like end plate 25B with an anchor leg 26B which has a lower end bent into a corresponding notch 13 formed in the lower end of a frame 90B. The studs 28 and 29 are spaced to receive therebetween the upper portion of a yoke 50B extending upwardly from the base 10B. One stud 28 is dimensioned to be capable of being guided through a clearance between the upper bent portion of the yoke 50B and the upper end of the end wall 12, while the other stud 29 is made larger not to pass the clearance but to be blocked against the side edge of the yoke 50B. The smaller stud 28 has its front end inclined outwardly to define thereat a taper end 28B. Assembly of the bobbin 21B on the base 10B is made by firstly engaging the anchor leg 26B to the notch 13, and guiding the smaller stud 28 into the clearance between the yoke 50 and the end wall 12. Then, the bobbin 21 is turned about the anchor leg 26B within a horizontal plane in such a way as to guide the smaller stud 28 further through the clearance with the tapered end 28B in sliding contact with the inner surface of the yoke 50B, during which the anchor leg 26 flexes resiliently to permit the sliding movement of the smaller stud 28 along the inner surface of the yoke 50B. After the stud 28 goes past the yoke 50B, it is urged outwardly by the resiliency of the anchor leg 26B into locked engagement with the side edge of the yoke 50B. At this condition, the other stud 29 comes into abutment with the opposite side edge of the yoke 50B for exact positioning of the bobbin 21B on the base 10B.

As shown in FIG. 10, an armature 30B coupled to the bobbin 21B is formed at its one end with a transversely extending bar 34 which rests on the top end of the yoke 50B to be pivotally supported thereat. The bar 34 has its lower surface curved to keep a line contact with the upper end of the yoke 50B during the pivot movement of the armature 30B, so that the armature 30B can constitute with the yoke 50B a magnetic circuit of constant resistance which will not vary with the armature movement between the rest and set positions, resulting in a reliable and stable armature operation. Also, the transversely extending bar 34 is advantageous for increasing the area of contact with the yoke 50B to thereby reduce the magnetic resistance between the armature 30B and the yoke 50B. A retainer spring 36 is utilized to interconnect the armature 30B and the yoke 50B. The retainer spring 36 is secured at its one end to the armature 30A inwardly of the bar 34. The other end portion of the spring 36 is bent downwardly along the upper portion of the yoke 50B and is formed at its lower end with a hook 37 which snaps into an eye 51 formed in the yoke 50B. Thus, the armature 30B is securely supported to the yoke 50B to give a fixed pivot axis to the armature 30B, preventing undesirable shifting of the pivot axis during the armature movement.

As shown in FIG. 11, the yoke 50B and the first pole member 41B are formed at their lower ends respectively with tongues 55 and 45 which are received in corresponding recesses 15 and 16 formed in the opposite ends of the base 10B. These tongues 55 and 45 are welded to the base 10B by directing laser radiations in the illustrated directions. With the laser welding, it is readily possible to exactly position the yoke 50B, the first pole member 41B and the associated parts on the base 10B, enabling a precise assembly of the relay and therefore assuring a reliable relay operation. In FIG. 11, the frame 90B which holds the first and second pole members 41B and 42B as well as the permanent magnet (not seen) is shown to have on its rear closed wall a pair of stop projections 100B which determines the gap distance with the Cover (not seen). The frame 90B is also formed integrally with an insulation plate 11B disposed between the coil 20B and the base 10B.

Figure 12:
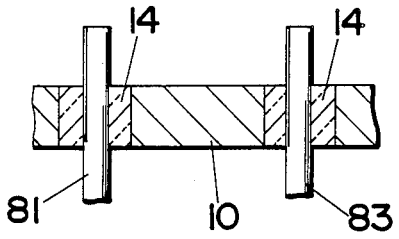
FIG. 12 is a partial view illustrating an arrangement of the terminal pins.
Figure 13A:
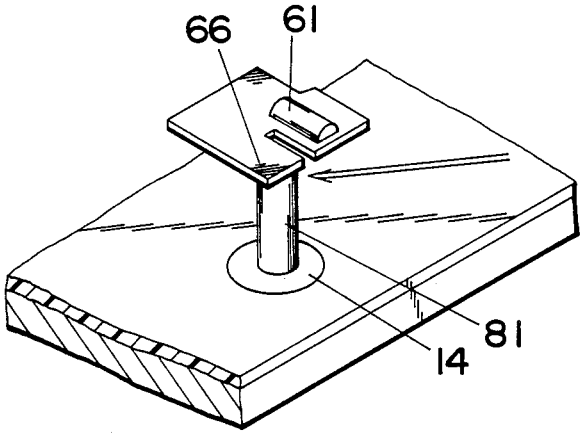
FIGS. 13A, 13B, and 13C are perspective views respectively illustrating directions of laser radiations for welding fixed contacts and movable contact to corresponding terminal pins.
Figure 13B:
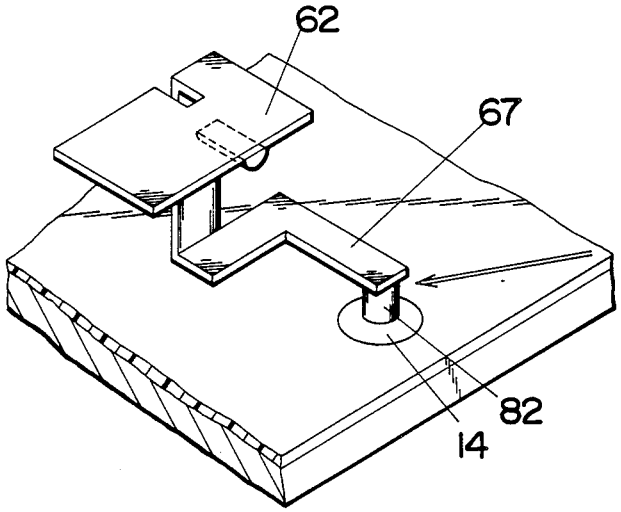
Figure 13C:
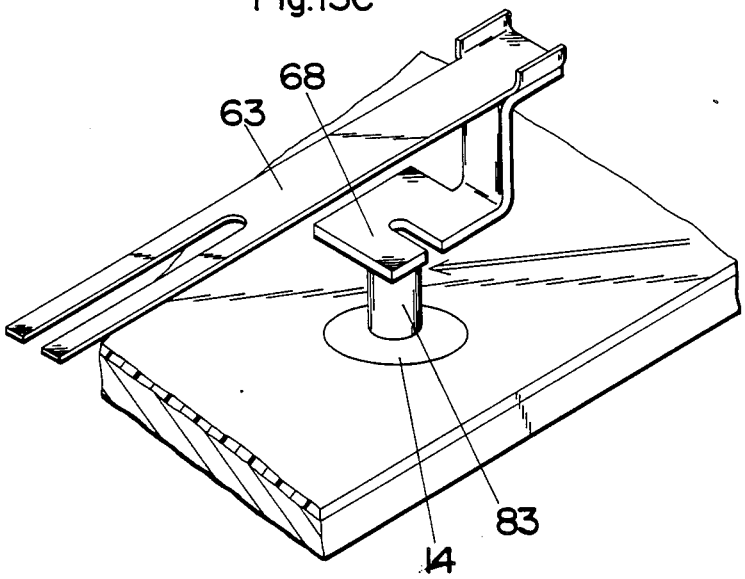

In the above embodiments, the terminal pins are insulated and sealed with respect to the base 10 by means of glass fittings 14 or the like insulation material, as shown in FIG. 12 in which only two terminal pins 81 and 83 are shown for simplicity. Due to the sealing by the glass fittings 14, the terminal pins may be displaced horizontally within the glass fittings 14 during the solidification thereof. Such undesirable horizontal displacement can be absorbed, as shown in FIGS. 13A to 13C and 14, at the respective junctures between the terminal pins 81 to 84 and corresponding members 61 to 64 and 24. In these figures, the first fixed contact 61, the second fixed contact 62, the movable contact 63, and coil pins 84 are formed respectively with horizontally extending tabs 66 to 68 and 86 which are welded to the corresponding terminal pins 81 to 83 and to coil lead 24. These welding is preferably made by laser welding technique, or by directing laser radiation in the directions as indicated in the figures. Since the pins 81 to 84 can be easily arranged to have the same height at the mounting of the pins to the base 10, the laser welding can be easily effected only in consideration of horizontally spaced target locations and without taking into account any vertical displacement between the target locations. Further, the pins 81 to 84 are aligned in two rows in the illustrated embodiments, they can be welded to the associated parts simultaneously by directing the laser radiations from either directions, which is advantageous to reduce assembling time. It is noted in this connection that, as shown in FIG. 14, the coil lead 24 is a plate-like member which is integrally formed with the coil bobbin 21 with its upper end molded therein and which is folded to catch a corresponding wire end 24E. The folded portion is subjected to the laser radiation in the illustrated direction to firmly secure the coil wire 24E to the lead 24 without applying excessive pressure to the wire 24E which would be otherwise the cause of wire breakage.

The above laser welding is also advantageous for fixing a retainer spring 36C to a like armature 30C as well as to a yoke 50C, as shown in FIG. 15 which also indicates the laser radiating directions. The laser welding can successfully eliminate an extra work which would otherwise necessary to remove a protective coating on the armature as required in the case of employing resistive welding. Further, the spring 36C can be easily welded to the armature and the yoke without the necessity of providing any projections or bosses for engagement therebetween. Also, the cover 70 is secured to the base 10 by the laser welding at the abutment between individual rims 71 and 17 such that these rims 71 and 17 can be free from any projections which would be required when using the resistive welding, leaving no undesirable gap between the rims 71 and 17 and therefore maintaining a predetermined dimensional relation between the base 10 and the cover 70. This assures to give dimensional stability to the above additional gap Ga between the cover 70 and the second pole member 42, thus enabling to effect the intended armature operation. Although the laser welding is preferred in the above embodiments, the present invention is not limited thereto and should be understood to employ other welding or fastening schemes.

What is claimed is:

1. In a polarized electromagnetic relay comprising:

a base made of magnetic material;

a contact assembly including at least one movable contact for contact with at least one fixed contact;

a polarized electromagnet mounted on said base and comprising;

an excitation coil, an armature extending through said coil and pivotally supported at its one end to said base with said one end magnetically coupled to said base, a pair of first and second pole members which are magnetized to opposite polarity by a permanent magnet coupled thereto, said first and second pole members defining therebetween a magnetic gap into which the other end of said armature extends such that said armature is movable between a rest position where the other end of said armature is attracted to said second pole member and a set position where the other end of said armature is attracted to said first pole member, said first pole member being magnetically coupled said base such that a magnet flux from said permanent magnet circulates through said first pole member, said base, said armature, and through said second pole member for attracting said armature to said rest position when said coil is deenergized and that a coil flux developed upon the energization of said coil circulates in an opposing direction to said magnet flux through said armature, said base, said first pole member and returns back to said armature for attracting said armature to said set position;

said armature operatively connected to said movable contact for bringing said movable contact into and out of said fixed contact as said armature moves between said set position and rest position;

a cover fitted over said base to enclose therebetween said electromagnet and said contact assembly;

said relay characterized in that said cover is made of magnetic material magnetically coupled to said base and in that said second pole member is positioned adjacent to said cover to define therebetween such an air gap that is cooperative with said second pole member, said armature, said base, and said cover to form an auxiliary flux loop which permits an additional coil flux caused by said coil energization to circulate therethrough in an opposing direction to said magnet flux at least at a portion between said second pole member and said armature.

2. A polarized electromagnetic relay as set forth in claim 1, wherein said first and second pole members are held together with said permanent magnet in a frame which is fixed to said base, said frame formed at a portion adjacent said second pole member with at least one stop projection which abuts against the inner surface of said cover so as to determine said air gap of a fixed distance between said second pole member and said cover.

3. A polarized electromagnetic relay as set forth in claim 1, said armature is magnetically coupled to said base through a yoke upstanding from said base, said armature having at said one end a transversely extending pivot projection which is supported on the top of said yoke to define a fixed pivot axis about which said armature pivots between said rest and set positions.

4. A polarized electromagnetic relay as set forth in claim 3, wherein said first pole member and said yoke are secured at their respective lower ends to said base by laser welding.

5. A polarized electromagnetic relay as set forth in claim 1, wherein said movable contact is in the form of a spring leaf which biases said armature to a neutral position between the rest and set positions, said magnet flux causing the armature to move to the rest position against said spring bias from said neutral position when the coil is deenergized, and said coil flux causing said armature to move to said set position against said spring bias.

* * * * *